United States Patent [19]

Peck et al.

[11] 3,978,540

[45] Sept. 7, 1976

[54] DISPOSABLE PICK-UP CONTAINER FOR ANIMAL LITTER

[76] Inventors: Bernard W. Peck, 4711 N. Lawndale Ave., Chicago, Ill. 60625; Larry P. Horist, 2709 Simpson St., Evanston, Ill. 60201

[22] Filed: Mar. 24, 1975

[21] Appl. No.: 561,110

[52] U.S. Cl. ..... 15/104.8; 294/1 R

[51] Int. Cl.[2] ..... A47L 13/52

[58] Field of Search ..... 15/104.8, 257.1, 257.6, 15/257.9; 294/1 R, 55; 229/54 R

[56] References Cited

UNITED STATES PATENTS

| | | | |
|---|---|---|---|
| 2,192,131 | 2/1940 | Fishwick | 229/54 R |
| 3,676,887 | 7/1972 | Klein | 15/104.8 |
| 3,739,418 | 6/1973 | Yonaites et al. | 15/104.8 |
| 3,767,247 | 10/1973 | Wetzler | 15/257.1 X |
| 3,782,622 | 1/1974 | Montgomery | 229/54 R |
| 3,877,742 | 4/1975 | Hatfield | 294/1 R X |

FOREIGN PATENTS OR APPLICATIONS

| | | | |
|---|---|---|---|
| 1,524,943 | 4/1968 | France | 229/54 R |

*Primary Examiner*—Daniel Blum
*Attorney, Agent, or Firm*—John S. O'Brien

[57] ABSTRACT

A disposable pick-up container for animal litter includes an open-mouthed bag of flexible material serving as a receptacle for animal litter and having a cuff portion around the mouth thereof, and a pair of scoops on opposite sides of the bag, the scoops each having a blade portion fixed to the cuff portion of the bag and a handle portion extending from the blade portion, the container being adapted for manipulation to pick up animal litter by grasping the handle portions of the scoops and placing the mouth of the bag around the litter, bringing the blade portions of the scoops together under the litter, picking up the litter by the blade portions and upending the bag to drop the litter by the blade portions and upending the bag to drop the litter thereinto, inserting the blade portions into the bag and thereby also folding the cuff portion so that it lies within the bag, and bringing the handle portions together for bag-closing and carrying purposes.

10 Claims, 12 Drawing Figures

DISPOSABLE PICK-UP CONTAINER FOR ANIMAL LITTER

BACKGROUND OF THE INVENTION

This invention relates to containers for animal litter having means for picking up and holding the litter for disposal.

Owing to the rapidly increasing pet population and increasing congestion within major urban areas, the retrieval and removal of, especially, canine litter has developed into a significant civic and public health issue. Concern results both from asthetic considerations and from the potential for transmission of disease. Communities have reacted increasingly to the problem, by publicity designed to encourage pet owners to exercise greater social responsibility, and by regulation.

The general willingness of pet owners to retrieve and properly dispose of litter is related to the ease, convenience and economy with which the litter may be handled in a clean and sanitary manner. While a number of articles and devices have been proposed for the purpose of disposing of animal litter, they have suffered from various shortcomings. Thus, devices have been provided which are not completely disposable and, therefore, require more or less cleanup. Those articles designed to be disposable may fail to be completely sanitary, permitting or being susceptible of contact of the litter with the hands or clothing. Such articles also may be bulky and inconvenient to carry and/or inconvenient or distasteful to use. The articles may be relatively expensive for frequent use and disposal. It would be advantageous if a disposable pick-up container were provided which does not suffer from such shortcomings.

SUMMARY OF THE INVENTION

The invention provides a disposable pick-up container for animal litter which includes an open-mouthed bag of flexible material serving as a receptacle for animal litter and having a cuff portion around the mouth thereof, and a pair of scoops on opposite sides of the bag, such scoops each having a blade portion fixed to the cuff portion of the bag and a handle portion extending from the blade portion, and the container being adapted for manipulation to pick up animal litter by grasping the handle portions of the scoops and placing the mouth of the bag around the litter, bringing the blade portions of the scoops together under the litter, picking up the litter by the blade portions and upending the bag to drop the litter thereinto, inserting the blade portions into the bag and thereby also folding the cuff portion of the bag so that it lies within the bag, and bringing the handle portions together for bag-closing and carrying purposes.

In preferred embodiments of the invention, the width of the blade portion of each of the scoops is about one-fourth of the circumference of the cuff portion of the bag, whereby one of the handle portions may be rotated 180° relative to the other handle portion to tighten the cuff portion of the bag around the blade portions of the scoops in bringing the handle portions together to close the bag. It is also preferred to provide fastening means on the handle portions of the scoops and serving to hold the bag closed.

The new pick-up container preferably is constructed of a bag formed of thin, flexible plastic sheet material, and scoops formed of cardboard or the like, although other materials which are conveniently and economically disposable may be employed. The pick-up container is used once and then disposed of, with no need for any accessory device and nothing to be cleaned thereafter.

The pick-up container is characterized by the high degree of sanitation it provides. Thus, the construction insures that the hands do not contact the litter, even through the bag, and the hands and clothing are kept clean in the process of picking up the litter. When the container is closed, all contaminated surfaces are inside of the bag, contact with the litter and contaminated surfaces is prevented, and odors are minimized.

The pick-up container is convenient for packaging, storing, and dispensing, and it is also convenient to carry, use and dispose of. Thus, the container initially is a thin, flat lightweight unit occupying minimal space. Litter is picked up by the container with but easy, rapid manual manipulation, without need for other implements or devices. When the litter has been picked up, the container is conveniently carried to a suitable waste receptacle and there disposed of.

The structure of the pick-up container is exceedingly simple and economical. It may be manufactured by mass production techniques. The resulting low cost per unit is an incentive for pet owners to diligently clean up litter.

BRIEF DESCRIPTION OF THE DRAWINGS

The attached drawings illustrate preferred embodiments of the invention, without limitation thereto. In the drawings, like elements are identified by like reference symbols in each of the views, and.

DESCRIPTION OF THE PREFERRED EMBODIMENTS

Figure 1:
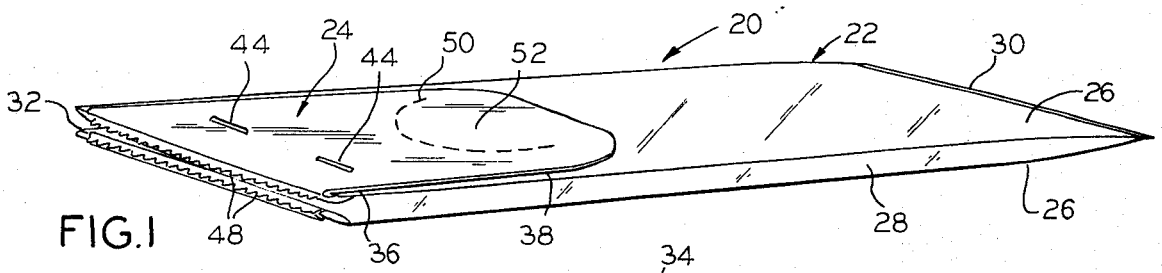
FIG. 1 is a perspective view of one embodiment of the pick-up container of the invention, illustrating the container when fully extended and as it normally appears prior to use.

Referring to FIGS. 1–5 of the drawings, a disposable pick-up container 20 is constructed according to a preferred embodiment of the invention. The container includes an open-mouthed thin, flexible plastic bag 22 serving as a receptacle for animal litter, and a pair of cardboard scoops 24 on opposite sides of the bag.

The bag 22 preferably is constructed of thin plastic sheet material, for example, polyolefin or polyvinyl, such as Saran, to achieve the advantages of disposability, relative water-imperviousness, lightness and compactness, strength, flexibility, economy, and adaptability to mass production. It will be apparent, however, that other sheet materials, for example, waterproofed paper, may be employed, if desired. The scoops 24 preferably are made of cardboard, paperboard, fiberboard or other composition board sheet material, providing the advantages of disposability, sufficient rigidity and strength, lightness and compactness, economy, and adaptability to mass production. The scoops, also, may be made of other material if desired, for example, of relatively stiff or rigid plastic sheet material, or from other material suitable for performing the same functions.

The bag 22 is folded to lie flat, and it includes two parallel flat rectangular sides 26 and two opposed folded sides 28 which integrally join the flat sides together along their longitudinal edges. The folded sides 28 each have a single fold, rendering them V-shaped in cross section. The flat sides 26 and the folded sides 28 are joined together along a sealed end 30 on the bag, sealing being effected by heat or solvent welding, or other suitable means. The opposite end of the bag 22 is open, forming a mouth 32 thereat, which is substantially closed in the condition of the bag illustrated in FIG. 1 and wide open in the condition illustrated in FIG. 2. A cuff portion 34 of the bag surrounds the mouth 32.

Each of the scoops 24 includes a U-shaped blade portion 36 fixed or attached to the cuff portion 34 of the bag and an integral handle portion 38 extending freely from the blade portion. Each of the scoops 24 has what is termed, for convenience, a front side 39 and a back side 40. Each blade portion 36 includes a front section 41 and a back section 42 joined together by a reverse bend 43.

The scoops 24 are secured to the flat sides 26 of the bag 22 along the mouth 32, with the back sides 40 of the scoops adjacent to the outer surfaces of the flat sides 26 of the bag. The cuff portion 34 of the bag is inserted between the front and back sections 41 and 42 of each blade portion 36, and the cuff and blade portions are secured together adjacent to the free edge of the back section 42 by staples 44. Alternatively, other fastening means, for example, an adhesive, may be employed to secure the illustrative blade portions 36, or other suitable blade portions, to the cuff portion 34. By this construction, the sections of the cuff 34 attached to the blade portions 36 will move together therewith.

The reverse bend 43 in each of the scoops 24 also constitutes a leading edge thereof, more particularly, of the blade portion 36 of each scoop. In the illustrative embodiment, a serrated strip 48 of rigid sheet material, such as metal or plastic, is fastened to the back section 42 of each blade portion 36 along and projecting from its leading edge 43. The serrated strips are an optional feature of the invention, assisting in picking up litter more carefully in certain instances, such as when the litter is found on rugs or carpets.

The scoops 24 extend from adjacent the bag mouth 32 towards the opposite, sealed end 30 of the bag 22, when the bag is fully extended, as in FIG. 1. The combined width of the blade portions 36 preferably is about one-half of the circumference of the cuff portion 34 of the bag. It is further preferred that each of the individual blade portions 36 have a width of about one-fourth of such circumference, for reasons which will appear. It is preferred that the blade portions be no wider than described, and they may be slightly narrower while achieving the desired results.

While the invention is not limited to particular dimensions, it is preferred that the width of the cuff portion 34, that is, the distance inward from the mouth 32, be about 1 to 1½ inches, for reasons which will appear. Convenient and suitable dimensions for the bag 22, in the condition in which it is illustrated in FIG. 1, are a length of about 8 inches and a width of about 4 inches. The corresponding circumference of the mouth 32, shown open in FIG. 2, may be about 16 inches. It will be understood, however, that the container 20 advantageously may be made in other sizes, and particularly, in somewhat larger sizes.

Figure 11:
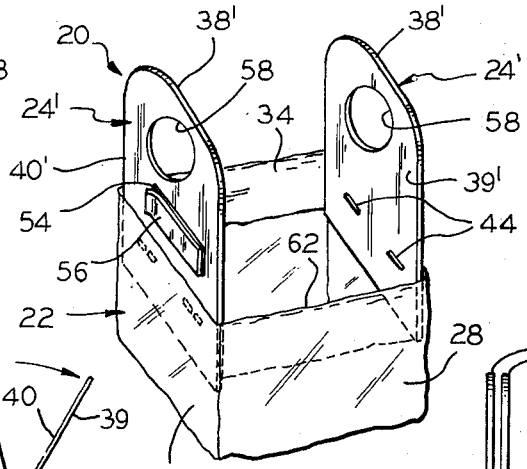
FIG. 11 is a fragmentary perspective view similar to FIG. 5, of a second embodiment of the pick-up container, having modified scoops and different fastening means.
Figure 12:
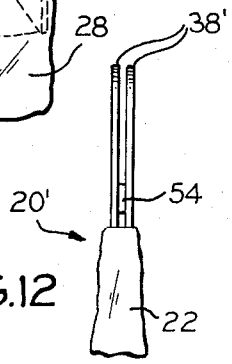
FIG. 12 is a schematic side elevational view similar to FIG. 10, illustrating the second embodiment in its closed and fastened condition.

The handle portions 38 of the scoops 24 are provided with means for fastening the handle portions together to hold the bag closed. Thus, each handle portion 38 is provided with an arcuate score or perforation line 50 defining a locking tab section 52. The tab sections may be pushed out along the score lines. When the handle portions 38 are brought together, as subsequently described, the score lines and the tab sections register with each other and may be manipulated to fasten the handles together. In the embodiment of FIGS. 11–12, wherein a modified container 20' is illustrated, other suitable fastening means are provided on the handle portions 38' of the scoops 24'. Thus, a pressure sensitive adhesive strip or layer 54 is provided on the back side 40' of one of the scoops 24', while the surface of the front side 39' of the remaining scoop 24' is suitably finished to provide good adhesion to the adhesive strip 54 when pressed thereagainst. The adhesive strip 54 is covered and protected by a release strip 56 prior to use. The handle portions 38' also are provided with finger openings 58, which are employed in carrying the container 20'.

Figure 2:
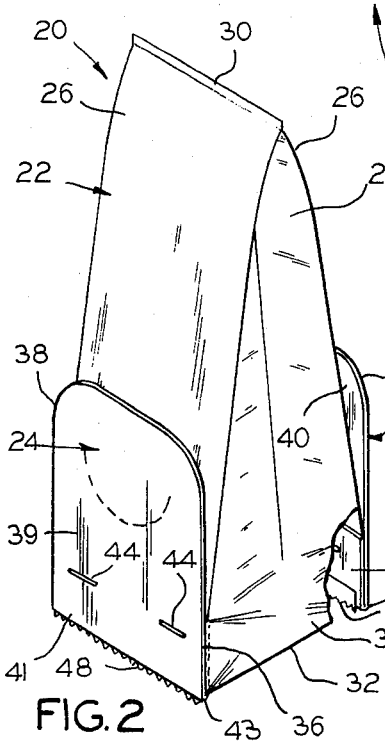
FIG. 2 is a perspective view of the container, with a portion broken away to reveal the interior, illustrating the manner in which the container is placed over animal litter before picking it up.
Figure 3:
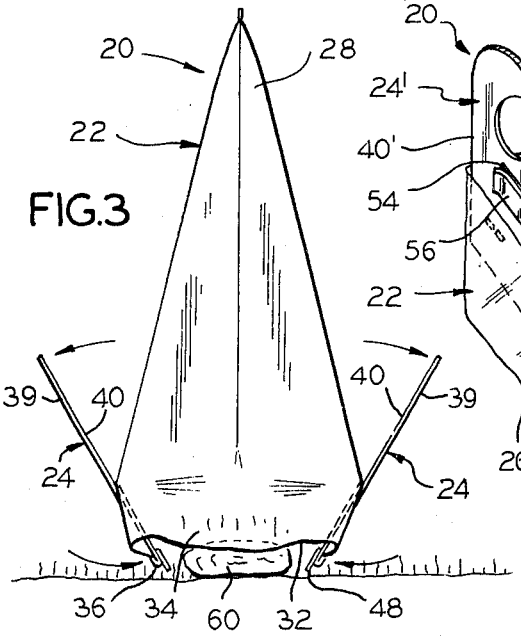
FIG. 3 is a side elevational view of the container, illustrating the next step in the pickup operation, of scooping up the litter.
Figure 4:
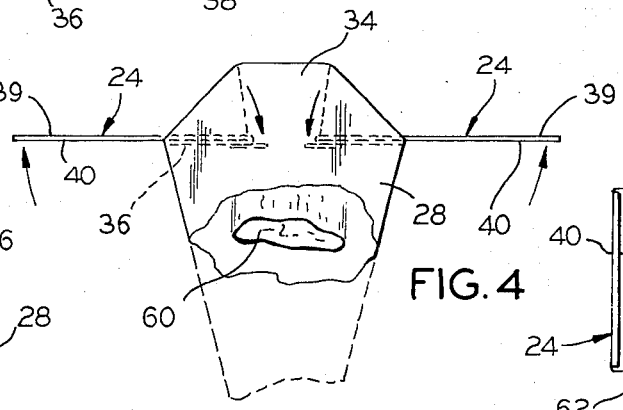
FIG. 4 is a fragmentary side elevational view of the container, with a portion of the bag broken away to reveal the interior, illustrating the container as it appears when upended after picking up the litter.

In use, the container 20 is placed with its mouth 32 around the litter or fecal matter 60 in the manner illustrated in FIGS. 2 and 3. The handle portions 38 of the scoops 24 are grasped by the fingers of the user, and the scoops are rotated generally about horizontal axes to bring their blade portions 36 together under the litter, while the handle portions are moved generally outwardly and downwardly, as illustrated in FIG. 3. The litter then is picked up by the blade portions 36, and the bag 22 is upended, as illustrated in FIG. 4, to drop the litter thereinto. At this time, the blade portions 36 extend inwardly over the interior of the bag, and the sections of the cuff portion 34 that are not directly attached to the blade portions may remain more or less upstanding.

Figure 5:
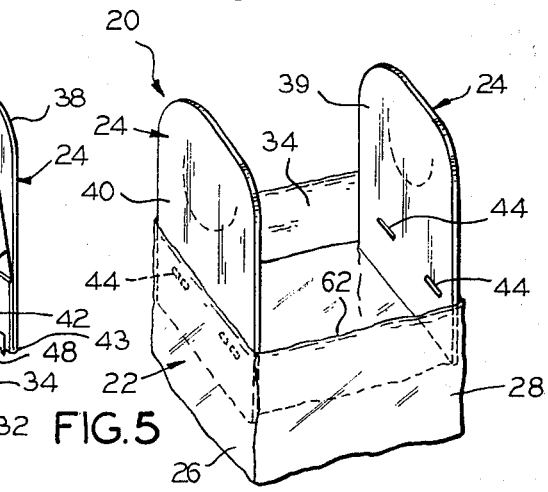
FIG. 5 is a fragmentary perspective view of the then upper end of the container, illustrating the container as it appears after the litter is dropped into the bag thereof and preparatory to closing the bag.

The blade portions 36 next are inserted into the bag 22, by further rotating the scoops 24 about generally horizontal axes, as indicated by the arrows in FIG. 4, so that the blade portions 36 are moved downwardly into the bag while the handle portions 38 are moved upwardly and inwardly. The cuff portion 34 of the bag, attached to the blade portions 36, is pulled into the bag by the blade portions, being automatically folded therein as illustrated in FIG. 5. At this time, the edges of the blade portions 36 with attached serrated strips 48, and the edges or the entire periphery of the cuff portion 34, the parts which may have become contaminated by contact with the litter 60, lie within the bag 22 in position to be completely enclosed therein.

The container 20 then may be closed, so as to contain the litter therein while giving off little or no odor, and to permit the container to be carried to a suitable waste receptacle or disposal point. For this purpose, the handle portions 38 of the scoops 24 simply may be brought together. It is preferred, however, to further manipulate the handle portions 38 so as to close the mouth of the bag 22 relatively tightly, thereby essentially eliminating odors and insuring that the litter remains inside of the bag at all times.

Figure 6:
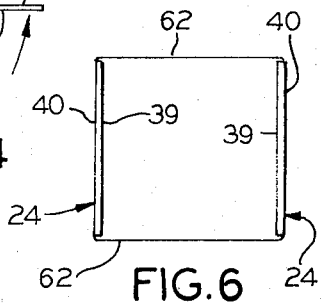
FIGS. 6 through 9 are schematic top plan views.
Figure 7:
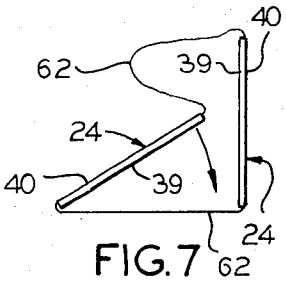
Figure 8:
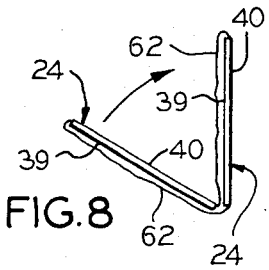
Figure 9:
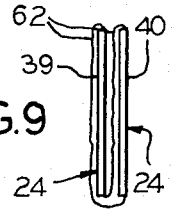

FIGS. 5–10 illustrate the manner in which the container 20 may be tightly closed when constructed according to the preferred embodiments of the invention. The handle portions 38 are drawn apart after depositing the litter 60 in the bag 22, so that the unattached sections of the cuff portion 34 and the resulting bag rim 62 are relatively taut, as illustrated in FIGS. 5 and 6. Then, one of the handle portions 38 is rotated 180° relative to the remaining handle portion 38 to bring the handle portions together and tighten the cuff portion 34 of the bag around the blade portions 36 of the scoops 24, as illustrated in FIGS. 7–9. It will be seen from these views that one handle portion 38 is brought up to one section of the cuff 34, which serves to draw both unattached cuff sections taut, as seen in FIG. 8. The rotation of the one handle portion 38 is completed, as illustrated in FIG. 9, to bring the handle portions together, with the back side 40 of the rotated handle portion against the front side 39 of the remaining handle portion. The cuff portion 34 having been drawn relatively taut and the unattached portions thereof being brought up against the scoops 24, the mouth of the bag 22 effectively is closed, substantially preventing escape of material or odors.

Figure 10:
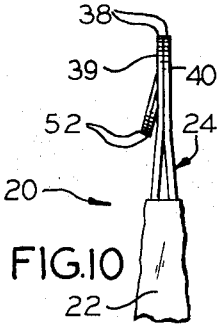
FIG. 10 is a schematic side elevational view, illustrating the container closing sequence, from the open condition of FIG. 6 to the closed and fastened condition of FIG. 10.

When the handle portions 38 are adjacent to each other, as illustrated in FIG. 10, the score lines 50 and the locking tab sections 52 are in register. At this time, the two tab sections 52 may be pushed out together from either side of the handle portions 38. One of the tab sections then projects through the resulting tab opening in the adjacent handle portion 38 and serves to fasten or lock the two handle portions 38 together to hold the bag 22 closed. The bag then may be carried by the handle portions 38, inserting one or more fingers through the openings left by the tab sections 52. Inasmuch as the container is well-closed, it may be transported in other ways, as in a vehicle, without problems, until a disposal site is reached. The container with the litter enclosed therein simply is dropped into any suitable waste receptacle, where it remains closed and inoffensive while awaiting removal.

In closing the container 20' illustrated in FIGS. 11 and 12, the release strip 56 is removed, and the procedure illustrated in FIGS. 7–9 is carried out. Then, the handle portions 38' are pressed together in the area of the adhesive strip 54, so that the strip becomes adhered to the front side 39' of the adjacent handle portion 38', thereby fastening the two handle portions 38' together, as illustrated in FIG. 12. The container 20' is disposed of in the same manner as with the preceeding embodiment.

The invention thus provides a disposable pick-up container for animal litter which is sanitary, asthetically acceptable, convenient in all of its aspects, and inexpensive. Its compact nature rends it suitable for carrying in a pocket or purse. For this purpose, the container 20 as shown in FIG. 1 may be folded in half. The container advantageously may be packaged either in the extended condition of FIG. 1 or in the folded condition, as desired. The container is easily manipulated to remove litter from various surfaces, including concrete, wood, grass, snow, and carpeting, and in hard-to-reach locations, such as under bushes.

While preferred embodiments of the invention have been illustrated and described, it will be apparent to those skilled in the art that various changes and modifications may be made therein within the spirit and scope of the invention. It is intended that all such changes and modifications be included within the scope of the appended claims.

We claim:

1. A disposable pick-up container for animal litter and which comprises, an open-mouthed bag of flexible material serving as a receptacle for animal litter and having a cuff portion around the mouth thereof, and a pair of scoops located outside said bag on opposite sides thereof, said scoops each having a blade portion fixed to the cuff portion of said bag at a predetermined position thereon and a handle portion extending from the blade portion, the said positions and the relative dimensions of the blade portions and the periphery of the cuff portion being such that when the container is manipulated to pick up animal litter, by grasping the handle portions of said scoops, placing the mouth of the bag around the litter, bringing the blade portions of said scoops together under the litter, picking up the litter by the blade portions, upending the bag to drop the litter thereinto, and inserting the blade portions into the bag, the cuff portion of the bag will fold automatically so that the blade portions and the periphery of the cuff portion both will lie completely within the bag, and the handle portions may be brought together for bag-closing and carrying purposes.

2. A pick-up container as defined in claim 1 and wherein the width of the blade portion of each of said scoops is about one-fourth of the circumference of the cuff portion of said bag, whereby the handle portion of one of the scoops may be rotated 180° relative to the handle portion of the other scoop to tighten the cuff portion of the bag around the blade portions of the scoops in bringing the handle portions together to close the bag.

3. A pick-up container as defined in claim 1 and including means on the handle portions of said scoops for fastening the handle portions together to hold the bag closed.

4. A pick-up container as defined in claim 3 and wherein said fastening means comprises tab sections defined by score lines in said handle portions and registering with each other when the handle portions are together, whereby the tab sections may be pushed out and one tab section pushed through the opening left in its handle portion by the other section for fastening the handle portions together.

5. A pick-up container as defined in claim 3 and wherein said fastening means comprise a layer of pressure-sensitive adhesive on one of said handle portions arranged to adhere to the other handle portion when the handle portions are together.

6. A pick-up container as defined in claim 3 and including a serrated strip extending along and projecting from the leading edge of the blade portion of each of said scoops.

7. A disposable pick-up container for animal litter and which comprises, an open-mouthed thin, flexible plastic bag serving as a receptacle for animal litter and having a cuff portion around the mouth thereof, and a pair of cardboard scoops on opposite sides of said bag and extending externally from adjacent the bag mouth towards the opposite end of the bag when the bag is fully extended, said scoops each having a blade portion fixed to the cuff portion of said bag at a predetermined position and a handle portion extending from the blade portion, the width of each blade portion being about one-fourth of the circumference of the cuff portion of the bag, the said positions being such that when the container is manipulated to pick up animal litter, by grasping the handle portions of said scoops, placing the mouth of the bag around the litter, bringing the blade portions of said scoops together under the litter, picking up the litter by the blade portions, upending the bag to drop the litter thereinto, and inserting the blade portions into the bag, the cuff portion of the bag will fold automatically so that the blade portions and the periphery of the cuff portion both will lie completely within the bag, and the handle portion of one of said scoops may be rotated 180° relative to the handle portion of the other scoop to bring the handle portions together and tighten the cuff portion of the bag around the blade portions of the scoops for bag-closing and carrying purposes.

8. A pick-up container as defined in claim 7 and including means on the handle portions of said scoops for fastening the handle portions together to hold the bag closed.

9. A pick-up container as defined in claim 1 and wherein said scoops extend externally from adjacent the bag mouth towards the opposite end of the bag when the bag is fully extended.

10. A pick-up container as defined in claim 2 and wherein said scoops extend externally from adjacent the bag mouth towards the opposite end of the bag when the bag is fully extended.

* * * * *